US010012161B2

(12) United States Patent
Shost et al.

(10) Patent No.: US 10,012,161 B2
(45) Date of Patent: Jul. 3, 2018

(54) TORQUE ESTIMATION IN A SKIP FIRE ENGINE CONTROL SYSTEM

(71) Applicants: Tula Technology, Inc., San Jose, CA (US); FCA US LLC, Auburn Hills, MI (US)

(72) Inventors: Mark A. Shost, Northville, MI (US); Ihab S. Soliman, Washington, MI (US); James J. Daley, Jackson, MI (US)

(73) Assignees: Tula Technology, Inc., San Jose, CA (US); FCA US LLC, Auburn Hills, MI (US)

( * ) Notice: Subject to any disclaimer, the term of this patent is extended or adjusted under 35 U.S.C. 154(b) by 48 days.

(21) Appl. No.: 15/171,931

(22) Filed: Jun. 2, 2016

(65) Prior Publication Data

US 2017/0350331 A1 Dec. 7, 2017

(51) Int. Cl.

| | |
|---|---|
| ***F02D 17/00*** | (2006.01) |
| ***F02D 41/00*** | (2006.01) |
| ***F02D 29/02*** | (2006.01) |
| ***F02D 41/26*** | (2006.01) |
| ***F02D 17/02*** | (2006.01) |
| ***F02D 13/06*** | (2006.01) |

(52) U.S. Cl.

CPC ..... *F02D 41/0085* (2013.01); *F02D 13/06* (2013.01); *F02D 17/00* (2013.01); *F02D 17/02* (2013.01); *F02D 29/02* (2013.01); *F02D 41/0087* (2013.01); *F02D 41/26* (2013.01); *F02D 2041/0012* (2013.01)

(58) Field of Classification Search

CPC ..... F02D 13/06; F02D 17/00; F02D 17/02; F02D 41/0087; F02D 2041/0012

USPC ..... 701/114; 123/481, 198 F; 73/114.15

See application file for complete search history.

(56) References Cited

U.S. PATENT DOCUMENTS

| | | | |
|---|---|---|---|
| 4,434,767 | A | 3/1984 | Kohama et al. |
| 4,489,695 | A | 12/1984 | Kohama et al. |
| 4,509,488 | A | 4/1985 | Forster et al. |
| 5,377,631 | A | 1/1995 | Schechter |
| 5,452,207 | A | 9/1995 | Hrovat et al. |
| 5,975,052 | A | 11/1999 | Moyer |
| 6,158,411 | A | 12/2000 | Morikawa |
| 6,619,258 | B2 | 9/2003 | McKay et al. |
| 7,063,062 | B2 | 6/2006 | Lewis et al. |

(Continued)

OTHER PUBLICATIONS

International Search Report dated Jul. 12, 2017 from International Application No. PCT/US2017/027962.

(Continued)

*Primary Examiner* — Erick Solis

(74) *Attorney, Agent, or Firm* — Beyer Law Group LLP

(57) ABSTRACT

In one aspect, a method is described. An operational engine torque is calculated. The engine is operated in a skip fire manner to deliver the operational engine torque. A reference engine torque is calculated using a torque model. The torque model involves estimating torque at a working chamber level. The reference engine torque is compared to the calculated operational engine torque to assess the accuracy of the operational engine torque calculation. Various embodiments of the present invention involve software, devices, systems and engine controllers that are related to one or more of the above operations.

33 Claims, 1 Drawing Sheet

(56) References Cited

U.S. PATENT DOCUMENTS

| | | | | |
|---|---|---|---|---|
| 7,066,136 | B2 | 6/2006 | Ogiso | |
| 7,085,647 | B1 | 8/2006 | Prucka et al. | |
| 7,086,386 | B2 | 8/2006 | Doering | |
| 7,503,312 | B2 | 3/2009 | Surnilla et al. | |
| 7,526,375 | B2 | 4/2009 | Buslepp et al. | |
| 7,577,511 | B1 | 8/2009 | Tripathi et al. | |
| 7,930,087 | B2 | 4/2011 | Gibson et al. | |
| 8,099,224 | B2 | 1/2012 | Tripathi et al. | |
| 8,103,433 | B2 * | 1/2012 | Hartmann | F02D 17/02 123/198 F |
| 9,086,020 | B2 | 7/2015 | Tripathi et al. | |
| 9,120,478 | B2 | 9/2015 | Carlson et al. | |
| 9,891,137 | B2 * | 2/2018 | Chen | G01M 15/05 |
| 2003/0116130 | A1 | 6/2003 | Kisaka et al. | |
| 2003/0213465 | A1 | 11/2003 | Fehl et al. | |
| 2006/0293829 | A1 | 12/2006 | Cornwell et al. | |
| 2007/0051351 | A1 | 3/2007 | Pallett et al. | |
| 2009/0118985 | A1 * | 5/2009 | Whitney | F02D 41/0087 701/105 |
| 2009/0229562 | A1 | 9/2009 | Ramappan et al. | |
| 2010/0050993 | A1 | 3/2010 | Zhao et al. | |
| 2010/0217472 | A1 * | 8/2010 | Stempnik | F02D 41/22 701/31.4 |
| 2012/0004821 | A1 | 1/2012 | Sano et al. | |
| 2012/0138005 | A1 | 6/2012 | White et al. | |
| 2014/0041625 | A1 | 2/2014 | Pirjaberi et al. | |
| 2014/0069377 | A1 | 3/2014 | Brennan et al. | |
| 2014/0251282 | A1 | 9/2014 | Kotwicki et al. | |
| 2014/0261309 | A1 * | 9/2014 | Chen | F02D 41/0082 123/320 |
| 2015/0233289 | A1 | 8/2015 | Younkins et al. | |
| 2015/0260117 | A1 | 9/2015 | Shost et al. | |
| 2016/0116371 | A1 * | 4/2016 | Chen | F02M 35/1038 73/114.37 |

OTHER PUBLICATIONS

Written Opinion dated Jul. 12, 2017 from International Application No. PCT/US2017/027962.

Nagashima et al., U.S. Appl. No. 15/918,284, filed Mar. 12, 2018.

* cited by examiner

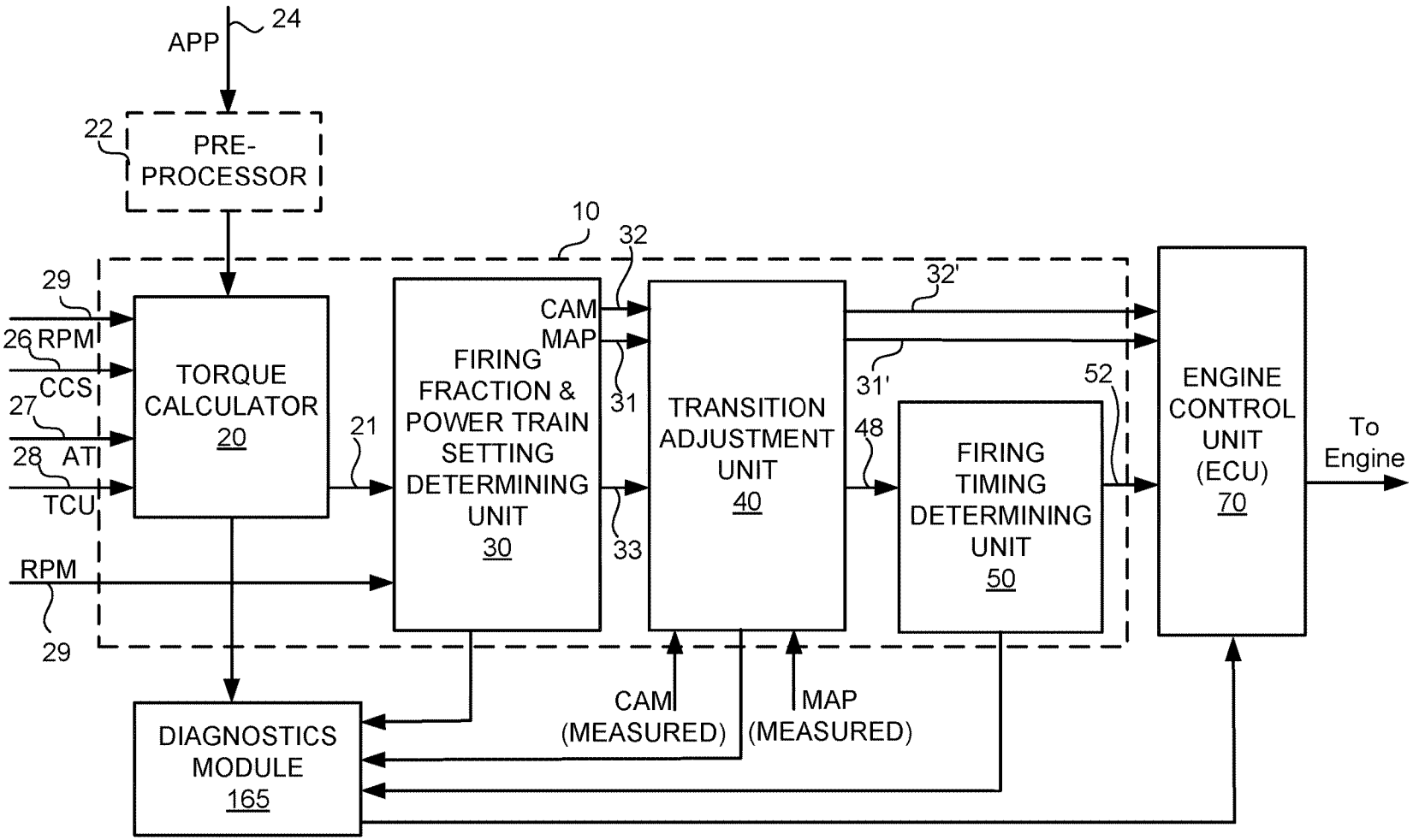
APP
24
PRE-PROCESSOR
22
TORQUE CALCULATOR 20
21
FIRING FRACTION & POWER TRAIN SETTING DETERMINING UNIT 30
CAM
MAP
10
32
31
33
TRANSITION ADJUSTMENT UNIT 40
32'
31'
48
FIRING TIMING DETERMINING UNIT 50
52
ENGINE CONTROL UNIT (ECU) 70
To Engine
29
26 RPM
CCS
27
28 ATI
TCU
RPM
29
CAM (MEASURED)
MAP (MEASURED)
DIAGNOSTICS MODULE 165

TORQUE ESTIMATION IN A SKIP FIRE ENGINE CONTROL SYSTEM

FIELD OF THE INVENTION

The present invention relates to a skip fire engine control system for an internal combustion engine. More specifically, the present invention relates to systems and methods for estimating the torque output of an engine that is operated in a skip fire manner.

BACKGROUND

In various conventional engine systems, when a request for engine torque is detected (e.g., using an accelerator pedal sensor), the electronic control unit (ECU) of the vehicle calculates an operational engine torque that would satisfy the torque request. The engine is then operated to deliver the desired torque.

Various engine systems also include a torque security monitor. The torque security monitor is arranged to ensure the accuracy of the calculated operational engine torque. Generally, the torque security monitor separately calculates the operational engine torque based on the settings used to operate the engine. If the engine torque calculated by the torque security monitor differs substantially from the original calculation, the torque security monitor may indicate that there is a problem with the calculation process, the engine settings and/or the engine controller.

SUMMARY OF THE INVENTION

A variety of methods and arrangements for estimating engine torque in a skip fire engine control system suitable for use as a torque security monitor are described. In one aspect, a method is described. An operational engine torque is calculated. The engine is operated in a skip fire manner to deliver the operational engine torque. A reference engine torque is calculated using a torque model. The torque model involves estimating torque at a working chamber level. The reference engine torque is compared to the calculated operational engine torque to assess the accuracy of the operational engine torque calculation. Various embodiments of the present invention involve software, devices, systems and engine controllers that are related to one or more of the above operations.

BRIEF DESCRIPTION OF THE DRAWINGS

The invention and the advantages thereof, may best be understood by reference to the following description taken in conjunction with the accompanying drawings in which:

FIG. 1 is a block diagram of an engine controller according to one embodiment of the present invention.

In the drawings, like reference numerals are sometimes used to designate like structural elements. It should also be appreciated that the depictions in the figures are diagrammatic and not to scale.

DETAILED DESCRIPTION

The present invention relates to a skip fire engine control system. More specifically, the present invention relates to controllers, systems and methods for estimating engine torque for an engine operated in a skip fire manner in manners suitable for use in a torque security monitor.

In various existing vehicle designs, when a driver presses the accelerator pedal, the engine controller of the vehicle estimates how much engine torque will be needed to meet the driver's needs. Various engine settings (e.g., mass air charge, air fuel ratio, spark advance, etc.) are selected based on the engine torque estimate. Based on the settings, the engine is then operated to deliver the estimated engine torque.

Various vehicle designs also include a torque security monitor. The torque security monitor is a diagnostic tool that calculates a reference engine torque based on the above selected engine settings. The torque security monitor uses the reference engine torque to check the accuracy of the initial engine torque estimate. If the difference between the operational engine torque and the reference engine torque is too great, the torque security monitor may determine that there is a problem with the engine, engine settings or the engine controller.

Generally, in conventional engine controller designs, when the torque security monitor calculates the reference engine torque, it is calculated at the engine level, rather than at the individual cylinder level. That is, differences in the conditions and settings for individual cylinders are not taken into account and torque output for a single or average cylinder is not modeled. This approach generally works well in a conventional all-cylinder engine system and reflects the fact that each cylinder in such a system is operated in generally the same manner and has similar characteristics i.e., each cylinder is fired during every engine cycle using similar settings. Thus, there is little need for the torque security monitor to take into account the characteristics of individual cylinders.

However, it has been determined that such approaches may be suboptimal if applied to skip fire engine control systems. This is because in skip fire engine control, working chambers may be operated differently. For example, at a given point in time, one working chamber may alternate between skips and fires more frequently than another working chamber. Unlike in conventional all-cylinder engines, in which every working chamber is fired during every working cycle, different working chambers in a skip fire engine control system may have different firing histories.

These differences in firing history can cause different working chambers in a skip fire engine control system to have different operating parameters and conditions e.g., different temperatures, mass air charge, spark advance settings, air fuel ratios, etc. Various embodiments of the present invention take these differences into account in determining a reference engine torque e.g., in some approaches, engine torque is estimated by first estimating torque at a working chamber level. As a result, the engine torque for a skip fire engine control system may be determined more accurately.

The Applicant has previously described a variety of skip fire controllers. A suitable skip fire controller 10 is functionally illustrated in FIG. 1. The illustrated skip fire controller 10 includes a torque calculator 20 (also sometimes referred to as engine torque determination unit 20), a firing fraction and power train settings determining unit 30, a transition adjustment unit 40, a firing timing determination unit 50 and a diagnostic module 165. For the purposes of illustration, skip fire controller 10 is shown separately from engine control unit (ECU) 70 which implements the commanded firings and provides the detailed component controls. However, it should be appreciated that in many embodiments the functionality of the skip fire controller 10 may be incorporated into the ECU 70. Indeed incorporation of the skip fire controller into an ECU or power train control unit is expected to be the most common implementation.

The torque calculator 20 is arranged to determine the desired engine torque at any given time based on a number of inputs. The torque calculator outputs a requested torque 21 to the firing fraction and power train settings determining unit 30. In various embodiments, the requested torque 21 may be presented in terms of an engine torque fraction (ETF) which is the fraction of the potentially available engine torque that is desired, rather than an absolute torque value. The firing fraction and power train settings determining unit 30 is arranged to determine a firing fraction that is suitable for delivering the desired torque based on the current operating conditions and outputs a desired operational firing fraction 33 that is appropriate for delivering the desired torque. Unit 30 also determines selected engine operating settings (e.g., manifold pressure 31, cam timing 32, torque converter slip, etc.) that are appropriate to deliver the desired torque at the designated firing fraction.

The firing fraction and power train settings determining unit 30 may use a wide variety of approaches to determine the appropriate engine settings for any particular operating conditions. By way of example, one suitable approach is briefly described next, although it should be appreciated that a wide variety of other approaches could be used as well. In the described approach, a fuel efficient base firing fraction ($FF_{base}$) is initially determined based on the engine torque fraction (ETF) signal 21. In many implementations, the firing fraction and engine and power train settings determining unit selects between a set of predefined firing fractions which are determined to have relatively good NVH characteristics.

Once the base firing fraction is established, a cylinder torque fraction (CTF) can be determined by dividing EFT by $FF_{base}$. That is:

$$CTF=EFT/FF_{base}$$

The CTF and engine speed may then be used as indices to a lookup table that indicates the most efficient cam setting. Based on the cam setting and the engine speed, a target intake manifold pressure (MAP) can be determined. The cylinder mass air charge (MAC) can be determined based on the cam settings, the manifold pressure, and the engine speed. A desired fuel mass can then be determined based on the MAC and stoichiometry considerations and any adjustments for spark timing may be set.

When the firing fraction and engine and power train settings determining unit selects between a set of predefined firing fractions, there are periodically transitions between desired operational firing fractions. It has been observed that transitions between operational firing fractions are a source of undesirable NVH. Transition adjustment unit 40 is arranged to adjust the commanded firing fraction and certain engine settings (e.g., camshaft phase, throttle plate position, intake manifold pressure, torque converter slip, etc.) during transitions in a manner that helps mitigate some of the transition associated NVH.

The firing timing determining unit 50 is responsible for determining the specific timing of firings to deliver the desired firing fraction. The firing sequence can be determined using any suitable approach. In some preferred implementations, the firing decisions are made dynamically on an individual firing opportunity by firing opportunity basis, which allows desired changes to be implemented very quickly. A variety of firing timing determining units that are well suited for determining appropriate firing sequences based on a potentially time varying requested firing fraction or engine output have been previously described by Tula. Many such firing timing determining units are based on a sigma delta converter, which is well suited for making firing decisions on a firing opportunity by firing opportunity basis. In other implementations, pattern generators or predefined patterns may be used to facilitate delivery of the desired firing fraction.

The torque calculator 20 receives a number of inputs that may influence or dictate the desired engine torque at any time. In automotive applications, one of the primary inputs to the torque calculator is the accelerator pedal position (APP) signal 24 which indicates the position of the accelerator pedal. In some implementations the accelerator pedal position signal is received directly from an accelerator pedal position sensor (not shown) while in others an optional preprocessor 22 may modify the accelerator pedal signal prior to delivery to the skip fire controller 10. Other primary inputs may come from other functional blocks such as a cruise controller (CCS command 26), the transmission controller (AT command 27), a traction control unit (TCU command 28), etc. There are also a number of factors such as engine speed that may influence the torque calculation. When such factors are utilized in the torque calculations, the appropriate inputs, such as engine speed (RPM signal 29) are also provided or are obtainable by the torque calculator as necessary.

Further, in some embodiments, it may be desirable to account for energy/torque losses in the drive train and/or the energy/torque required to drive engine accessories, such as the air conditioner, alternator/generator, power steering pump, water pumps, vacuum pumps and/or any combination of these and other components. In such embodiments, the torque calculator may be arranged to either calculate such values or to receive an indication of the associated losses so that they can be appropriately considered during the desired torque calculation.

The nature of the torque calculation will vary with the operational state of the vehicle. For example, during normal operation, the desired torque may be based primarily on the driver's input, which may be reflected by the accelerator pedal position signal 24. When operating under cruise control, the desired torque may be based primarily on the input from a cruise controller. When a transmission shift is imminent, a transmission shifting torque calculation may be used to determine the desired torque during the shifting operation. When a traction controller or the like indicates a potential loss of traction event, a traction control algorithm may be used to determine the desired torque as appropriate to handle the event. In some circumstances, depression of a brake pedal may invoke specific engine torque control. When other events occur that require measured control of the engine output, appropriate control algorithms or logic may be used to determine the desired torque throughout such events. In any of these situations, the required torque determinations may be made in any manner deemed appropriate for the particular situation. For example, the appropriate torque determinations may be made algorithmically, using lookup tables based on current operating parameters, using appropriate logic, using set values, using stored profiles, using any combinations of the foregoing and/or using any other suitable approach. The torque calculations for specific applications may be made by the torque calculator itself, or may be made by other components (within or outside the ECU) and simply reported to the torque calculator for implementation.

The firing fraction and power train settings determining unit 30 receives requested torque signal 21 from the torque calculator 20 and other inputs such as engine speed 29 and various power train operating parameters and/or environmental conditions that are useful in determining an appropriate operational firing fraction 33 to deliver the requested torque under the current conditions. Power train parameters include, but are limited to throttle position, cam phase angle, fuel injection timing, spark timing, torque converter slip, transmission gear, etc. The firing fraction is indicative of the fraction or percentage of firings that are to be used to deliver the desired output. In some embodiments the firing fraction may be considered as an analog input into a sigma-delta converter. Often, the firing fraction determining unit will be constrained to a limited set of available firing fractions, patterns or sequences that have been selected based at least in part on their relatively more desirable NVH characteristics (collectively sometimes referred to herein generically as the set of available firing fractions). There are a number of factors that may influence the set of available firing fractions. These typically include the requested torque, cylinder load, engine speed (e.g. RPM) and current transmission gear. They may potentially also include various environmental conditions such as ambient pressure or temperature and/or other selected power train parameters. The firing fraction determining aspect of unit 30 is arranged to select the desired operational firing fraction 33 based on such factors and/or any other factors that the skip fire controller designer may consider important. By way of example, a few suitable firing fraction determining units are described in application Ser. Nos. 13/654,244; 13/654,248, 13/963,686, 14/638,908, and 62/296,451, each of which are incorporated herein by reference.

The number of available firing fractions/patterns and the operating conditions during which they may be used may be widely varied based on various design goals and NVH considerations. In one particular example, the firing fraction determining unit may be arranged to limit available firing fractions to a set of 29 possible operational firing fractions—each of which is a fraction having a denominator of 9 or less—i.e., 0, 1/9, 1/8, 1/7, 1/6, 1/5, 2/9, 1/4, 2/7, 1/3, 3/8, 2/5, 3/7, 4/9, 1/2, 5/9, 4/7, 3/5, 5/8, 2/3, 5/7, 3/4, 7/9, 4/5, 5/6, 6/7, 7/8, 8/9 and 1. However, at certain (indeed most) operation conditions, the set of available firing fraction may be reduced and sometimes the available set is greatly reduced. In general, the set of available firing fractions tends to be smaller in lower gears and at lower engine speeds. For example, there may be operating ranges (e.g. near idle and/or in first gear) where the set of available firing fractions is limited to just two available fractions—(e.g., 1/2 or 1) or to just 4 possible firing fractions—e.g., 1/3, 1/2, 2/3 and 1. Of course, in other embodiments, the permissible firing fractions/patterns for different operating conditions may be widely varied.

When the available set of firing fractions is limited, various power train operating parameters such as mass air charge (MAC) and/or spark timing will typically need to be varied to ensure that the actual engine output matches the desired output. In the embodiment illustrated in FIG. 1, this functionality is incorporated into the power train settings component of unit 30. In other embodiments, it can be implemented in the form of a power train parameter adjusting module (not shown) that cooperates with a firing fraction calculator. Either way, the power train settings component of unit 30 or the power train parameter adjusting module determines selected power train parameters that are appropriate to ensure that the actual engine output substantially equals the requested engine output at the commanded firing fraction and that the wheels receive the desired brake torque. Torque converter slip may be included in the determination of appropriate power train parameters, since increasing the torque converter slip will generally decrease the perceived NVH. Depending on the nature of the engine, the air charge can be controlled in a number of ways. Most commonly, the air charge is controlled by controlling the intake manifold pressure and/or the cam phase (when the engine has a cam phaser or other mechanism for controlling valve timing). However, when available, other mechanism such as adjustable valve lifters, air pressure boosting devices like turbochargers or superchargers, air dilution mechanism such as exhaust gas recirculation or other mechanisms can also be used to help adjust the air charge. In the illustrated embodiment, the desired air charge is indicated in terms of a desired intake manifold pressure (MAP) 31 and a desired cam phase setting 32. Of course, when other components are used to help regulate air charge, there may be indicated values for those components as well.

The firing timing determining module 50 is arranged to issue a sequence of firing commands 52 that cause the engine to deliver the percentage of firings dictated by a commanded firing fraction 48. The firing timing determining module 50 may take a wide variety of different forms. By way of example, sigma delta convertors work well as the firing timing determining module 50. A number of Tula's patents and patent applications describe various suitable firing timing determining modules, including a wide variety of different sigma delta based converters that work well as the firing timing determining module. See, e.g., U.S. Pat. Nos. 7,577,511, 7,849,835, 7,886,715, 7,954,474, 8,099,224, 8,131,445, 8,131,447, 8,839,766 and 9,200,587. The sequence of firing commands (sometimes referred to as a drive pulse signal 52) outputted by the firing timing determining module 50 may be passed to an engine control unit (ECU) 70 or another module such as a combustion controller (not shown in FIG. 1) which orchestrates the actual firings. A significant advantage of using a sigma delta converter or an analogous structure is that it inherently includes an accumulator function that tracks the portion of a firing that has been requested, but not yet delivered. Such an arrangement helps smooth transitions by accounting for the effects of previous fire/no fire decisions.

When a change in firing fraction is commanded by unit 30, it will often (indeed typically) be desirable to simultaneously command a change in the cylinder mass air charge (MAC). As discussed above changes in the air charge tend to be realized more slowly than changes in firing fraction can be implemented due to the latencies inherent in filling or emptying the intake manifold and/or adjusting the cam phase. Transition adjustment unit 40 is arranged to adjust the commanded firing fraction as well as various operational parameters such as commanded cam phase and commanded manifold pressure during transitions in a manner that mitigates unintended torque surges or dips during the transition. That is, the transition adjustment unit manages at least the target cam phase, manifold pressure and firing fractions during transitions between commanded firing fractions. It may also control other power train parameters, such as torque converter slip.

The diagnostic module 165 is arranged to perform a number of skip fire related diagnostics. This can include misfire related diagnostics, cylinder valve actuation related diagnostics, emissions related diagnostics etc.

The desired settings for many of the power train operating parameters are interrelated and determined based in part on the expected operational engine torque output. Thus, the operational torque fraction determined by torque calculator 20 is used by the firing fraction and power train settings determining unit 30 in the determination the various operating parameters used during skip fire operation. However, there is always a possibility that the operational torque calculation could be off. If the torque calculation is off for any reason, then the various power train settings would likely be sub-optimal. Therefore, it is desirable to provide an independent reference estimation/calculation of the engine torque that can be used to provide a check for the main calculation. To be most useful, the reference engine torque calculation preferably uses a different methodology to estimate the engine torque than the main torque calculation that is used by torque calculator 20 or the firing fraction and/or power train setting determining unit 30. The independent estimation can be performed by diagnostic module 165, the torque calculator 20, the ECU 70 or by any other suitable module.

In some embodiments, (such as the embodiment described above), the firing fraction and power train setting determining unit 30 utilizes engine level torque estimates as the basis for determining various engine settings. In such cases, it may be desirable (although not necessary), to determine the reference engine torque, at the working chamber level, rather than only at the engine level. In other embodiments, the reference torque calculation could be on an engine cycle basis or a time dependent window that is deemed relevant to maintaining safety, as for example every 500 msec. It should be appreciated that the appropriate reference torque calculation for the Torque Security function will vary with both (a) the nature of the operational torque calculation (since it is desirable to use a reference torque calculation approach that is different than the operational torque calculation approach); and (b) torque security function design considerations. The reference torque calculation may be done in a variety of ways. In various embodiments, for example, the diagnostic module 165 uses an algorithm, formula or model to determine the torque of an individual or average working chamber and then scales or modifies the determined working chamber output (e.g., based on a firing fraction) to calculate a torque output for the engine as a whole. In various embodiments, the model/algorithm is based on various operating parameters, including but not limited to MAC, air fuel ratio, spark advance and engine speed. In other implementations, the torque of each individual working chamber is separately calculated and then the calculated torque outputs for the working chambers are summed to determine a reference engine torque. That is, the different operating parameters (e.g., different MAC, spark advance, air fuel ratio, etc.) used to operate the engine may be monitored and used to determine the torque output of each working chamber. Such approaches allow the diagnostic module 165 to take into account the different firing histories and conditions of different working chambers in a skip fire engine control system.

Different firing histories can affect the operating parameters and conditions in individual working chambers in various ways. For instance, consider an example in which the firing fraction determining unit 30 determines that a firing fraction of 4/7 would deliver the desired torque. In this example, the firing timing determination module 50 uses a sigma delta converter to generate a skip fire firing sequence in which fires and skips are substantially evenly spaced, although the sequence may be generated using other techniques as well. Over time, different working chambers will be fired and skipped using different patterns than other working chambers. For example, for a particular period of time, one working chamber may be fired more times in a row before a skip than another working chamber.

If a working chamber is fired more times in a row, its internal temperature tends to be greater. This can affect the settings and operational parameters for the working chamber. If the temperature of the working chamber is hotter, for example, air is not drawn in as easily into the working chamber than if the temperature was cooler. This can result in a lower mass air charge for that particular working chamber relative to other working chambers.

Differences can arise with a variety of other operating parameters as well. For example, advancing the spark generally allows a working chamber to generate more power. However, if the spark is advanced too much, the likelihood of a detonation may increase. Detonations typically are higher when the pressures and temperatures in a working chamber are high. Thus, if a working chamber is running hotter because of multiple fires in a row, the spark may be advanced less than in a working chamber with a different firing history i.e., in which there are fewer fires in a row between skips.

The diagnostic module 165 may be arranged to take the above differences in firing histories, working chamber operating parameters and conditions into account when determining the reference working chamber torque. For instance, in some implementations, the different firing histories and operating parameters of the working chambers are known based on the firing fraction. That is, for different firing fractions, it is known how much parameters such as spark advance and MAC may differ between various working chambers. To take this into account, the diagnostic module calculates a torque output for an each working chamber. The calculation may assume operating parameters (e.g., spark advance, MAC, etc.) that are the average of the different, known parameters for multiple working chambers and then make adjustments on a per working chamber basis. Alternatively, individual operating parameters may be determined for each individual working chamber. These parameters may vary with the firing history of the working chamber and also with other engine parameters, such as the firing fraction.

To reiterate, it should be appreciated that during skip fire operation, the actual torque output of a particular working chamber may vary between different engine cycles even during steady state operation of the engine. That is due in part to the fact that the individual cylinder's firing history will often be different from engine cycle to engine cycle. For example, if a 4 or 8 cylinder engine is operated at steady state using a ⅔ firing fraction, each cylinder will typically have a firing sequence equivalent to FFSFFSFFSFFS . . . (where F=fire and S=skip), although the phase of the sequences for the different cylinders will vary. In this sequence the torque output of the cylinder will be greater in the firing that immediately follows the skip than the firing that immediately follows a previous firing. These differences can readily be accounted for in the individual working chamber torque output calculations.

The working chamber torque and operating parameters may be determined using any suitable technique, model, algorithm or formula. For instance, in some embodiments, mass air charge is calculated using input from an air flow sensor and/or using a speed density calculation. As described in co-pending U.S. patent application Ser. No. 13/794,157, skip fire operation may compromise the accuracy of these well known MAC determination methods. In some embodiments the methods of MAC determination described in U.S. patent application Ser. No. 13/794,157, which is incorporated herein in its entirety for all purposes, may be used. One or more operating parameters may also be based on the engine parameters actually used to operate engine e.g., based on input from the power train setting determining unit 30. Some examples of formulas used to calculate the operating parameters and the reference working chamber torque are described below.

Once the reference working chamber torque has been determined, the diagnostic module 165 uses the reference working chamber torque to determine the reference engine torque. In some embodiments, the diagnostic module 165 determines a net engine torque (e.g., total torque applied to the engine, which includes torque lost to friction or pumping losses) as well as an engine brake torque (e.g., torque generated by the engine, after pumping losses and friction have been taken into account.) To estimate the engine brake torque, the diagnostic module 165 determines the effects of friction/pumping losses (e.g., torque losses caused by friction). In various embodiments, the diagnostic module 165 determines the effects of friction based on the skip fire firing fraction.

The diagnostic module 165 is arranged to then compare the calculated reference engine brake torque to the operational torque calculated by the engine torque determination unit 20. In various embodiments, if the discrepancy between the two values exceeds a particular threshold, the diagnostic module 165 determines that there may be an error e.g., in the engine or the engine controller. In some embodiments, the diagnostic module 165 transmits a signal, which causes a warning or signal to be displayed e.g., on the dashboard of a vehicle, to indicate that the problem should be addressed, This warning signal may also be integrated into a vehicle on board diagnostic (OBD) system.

The engine torque determination unit 20, the firing fraction and power train setting determining unit 30, the firing timing determination module 50, the diagnostic module 165 and the other illustrated components of FIG. 1 may take a wide variety of different forms and their functionalities may alternatively be incorporated into an ECU, or provided by other more integrated components, by groups of subcomponents or using a wide variety of alternative approaches. In various alternative implementations, these functional blocks may be accomplished algorithmically using a microprocessor, ECU or other computation device, using analog or digital components, using programmable logic, using combinations of the foregoing and/or in any other suitable manner.

The skip fire controller 70 and ECU cooperate to operate the engine in a skip fire manner. A wide variety of skip fire engine control methods may be used. In general, skip fire engine control contemplates selectively skipping the firing of certain cylinders during selected firing opportunities. Thus, a particular cylinder may be fired during one engine cycle and then may be skipped during the next engine cycle and then selectively skipped or fired during the next. In this manner, even finer control of the effective engine displacement is possible. For example, firing every third cylinder in a 4 cylinder engine would provide an effective displacement of $\frac{1}{3}^{rd}$ of the full engine displacement, which is a fractional displacement that is not obtainable by simply deactivating a set of cylinders. Similarly, firing every other cylinder in a 3 cylinder engine would provide an effective displacement of ½, which is a fractional displacement that is not obtainable by simply deactivating a set of cylinders. U.S. Pat. No. 8,131,445 (which was filed by the assignee of the present application and is incorporated herein by reference in its entirety for all purposes) teaches a variety of skip fire engine control implementations.

As discussed above, the diagnostic module 165 (or other suitable component) is arranged to provide one or more independent reference estimation/calculations indicative of the engine torque that can be used to provide a check for the main calculation. If the difference between the two values exceeds a threshold, an appropriate error flag can be raised in the on-board diagnostics (OBD) systems. If the difference is significant enough, the driver can be alerted through the activation of a check engine light or the use of another appropriate drive notification mechanism.

As will be appreciated by those familiar with the art, the torque output of a cylinder can be calculated in a variety of different manners, and there are a variety of different parameters that are generally indicative of a cylinder's expected torque. Thus, the reference check(s) doesn't/don't necessarily need to be an explicit torque calculation. Rather, the reference check may be of any parameter that is generally representative of engine torque and the reference may be compared to the corresponding value that is used by the skip fire controller 10 in the determination of the various engine settings.

For example, as is well known in the art, a cylinder's Mass Air Charge (MAC) is often used in cylinder torque calculations and can sometimes be used as a proxy indicative of expected cylinder torque output. Thus, parameters like MAC that are indicative of engine output may be determined by the diagnostic module in the reference check and compared to the values of corresponding parameters utilized by the skip fire controller 10, or translated into and compared to values that are used by the skip fire controller. For example, if the skip fire controller utilizes parameters such as engine torque fraction (ETF), or cylinder torque fraction (CTF) as described above, the values calculated as a reference check by the diagnostic unit 165 may be converted to ETF or CTF and compared to the corresponding values utilized by the skip fire controller 10, or vice versa.

By way of example, one specific reference check approach is to calculate a Net Mean Effective Pressure (NMEP) of each fired working chamber. NMEP can be determined a variety of different ways. By way of example, a polynomial equation can often be constructed to calculate NMEP within an expected cylinder operating range. For instance, one example formula for determining the NMEP of an average fired working chamber is provided below:

$$\begin{aligned}\text{NMEP}=&-1.0694-0.0046082a-0.11426b+\\&0.0090753b^2+14.6983c-1.4779c^2+0.059602ac-\\&0.00070015a^2c+0.15207ac^2-00012281d+\\&(3.1081*10^{-8})d^2-0.00049374cd\end{aligned} \quad \text{(Equation 1)}$$

where a=spark advance (0-60' BTDC), b=air fuel ratio (AFR), c=MAC (g/cyl/cycle) and d=engine speed (RPM). In order to use Eq. 1 to determine NMEP the four input variables must be determined. The spark advance (variable "a" in Eq. 1) may be received from the power train setting determining unit 30. Engine speed (variable "d" in Eq. 1) may be determined by a crankshaft speed sensor. MAC (variable "c" in Eq. 1) may be determined using a cam phase sensed by a cam phase sensor, an intake manifold pressure sensed by an intake manifold pressure sensor, an air temperature sensed by a temperature sensor, and an engine speed sensed by a crankshaft rotation sensor. The air fuel ratio (variable "b" in Eq. 1) may be directly measured using a sensor located downstream of the engine in an exhaust system. With all the variables known, Eq. 1 may then be used to determine NMEP for the average fired working cycle for any particular working chamber. Using the known firing fraction, the operational engine torque may be determined by based on the torques (NMEPs) produced by the individual working chambers. It should be appreciated that the NMEP formula set forth above is simply an example and that the nature of the polynomial used and the actual values of the constant used would vary for any particular engine design. As discussed above, this calculation may alternatively be made on a cylinder-by-cylinder basis and the results of the fired cylinders may be summed together to determine the net torque of the engine.

Another reference checking approach would be to calculate MAC based on a polynomial in a similar type of manner. For example, an engine specific formula for MAC might look like the following:

$$MAC=-0.50137+7.1986e-05*a+0.090317*b-0.0035901*b^2+0.073815*c-0.00034443*c^2-0.00049097*a*c+2.3724e-06*a^2*c-2.8312e-05*a*c^2+2.2408e-05*d-5.1431e-09*d^2+2.7313e-06*c*d;$$

where: a=spark advance (0-60 BTDC), b=air fuel ration (AFR). c=NMEP (bar), and d=rpm. In this example, an average expected value of NMEP may be used in the MAC calculation.

A particular reference checking approach will be described next. In this embodiment, the diagnostic module 165 determines a reference engine torque using a torque model wherein the torque model involves estimating torque at a working chamber level. That is, the diagnostic module 165 determines an estimated amount of torque that an individual (fired) working chamber generates, for the purpose of evaluating the accuracy of the engine torque calculated in step 210. The negative torque contribution of unfired, skipped cylinder may also be included in the reference engine torque calculation. (It is believed that conventional engine systems do not estimate torque on the working chamber level for this purpose.) The working chamber torque may be any value that corresponds to, is proportional to or represents working chamber torque. For instance, in some of the examples described herein, net mean effective pressure (NMEP) is calculated for a working chamber, although any other suitable value may be used e.g., indicated mean effective pressure (IMEP), cylinder torque fraction (CTF), etc.

To determine the working chamber torque, the diagnostic module 165 determines various operating parameters, such as spark advance, air fuel ratio, mass air charge and engine speed (e.g., variables a-d above.) The variables are generally determined using a different method than that used to determine the operational engine torque so as to provide an independent estimate of engine torque.

For example, mass air charge may be determined in a variety of ways. Any known mass air charge calculation method may be used e.g., techniques involving input from an air flow sensor may be used instead of a speed density-based approach. Alternatively, the approach described in co-pending U.S. patent application Ser. No. 13/794,157, which is incorporated herein in its entirety for all purposes, may be used. Instead of measuring the air fuel ratio as described above, a fuel charge may be calculated based on an injector characteristic curve. Using a MAC value calculated by any known method an air fuel ratio can be determined.

It should be appreciated that the MAC can differ significantly between successive firings, especially in engines having fewer numbers of working chambers, i.e. 3 and 4 cylinder engines. Consider the case of a 4 cylinder engine operating at a firing fraction of ¾. In this case the first firing after the skipped firing opportunity will have a relatively high MAC, the second firing an intermediate MAC, and the third and final firing a lower MAC. The intake manifold will then refill during the skipped firing opportunity and the cycle will repeat.

The diagnostic module 165 calculates the reference engine torque using a torque model wherein the torque model involves estimating torque at a working chamber level. As previously described the torque output of any working chamber will vary with its firing history. Thus the values of the variables used in Eq. 1 may be adjusted in a known manner on a working chamber by working chamber basis to provide a more accurate reference engine torque. Alternatively, the calculation may assume operating parameters (e.g., spark advance, MAC, etc.) that are the average of the different, known parameters for multiple working chambers and then make adjustments on a per working chamber basis. The torque model may use Eq. 1 or a different torque model based on a different equation and perhaps different input variables. Alternatively, a look up table may be used to determine the reference engine torque.

After the working chamber torque is estimated, the diagnostic module 165 determines a reference engine torque. In this particular example, the diagnostic module 165 determines a reference engine net torque. That is, the diagnostic module determines the total torque produced by the engine (some of which may be lost in the form of friction or pumping losses.)

To determine the reference engine net torque, in various embodiments, the reference working chamber torque is scaled to determine the torque on an engine level, rather than on a working chamber level. In various embodiments, the scaling is based on a firing fraction used to operate the working chambers of the engine (e.g., firing fraction 119 of FIG. 1).

The diagnostic module 165 then determines a reference engine brake torque. The reference engine brake torque indicates the torque output of the engine and thus takes into account factors such as friction and pumping losses. In various implementations, the reference engine brake torque is the reference engine net torque, minus torque lost due to friction and pumping losses.

Friction may be estimated in a variety of ways. In some embodiments, for example, the friction estimation is based on the firing fraction. This is because the firing fraction/frequency can affect the amount of pumping losses and friction in a skip fire engine control system. For instance, if more working chambers are fired, there may be more friction and pumping losses due to the repeated opening and closing of the intake and exhaust valves. If more working chambers are skipped, there may be lower pumping losses, since the valves are not opened and closed as often. Put another way, the friction estimate and/or the calculation of the reference brake torque based on the reference net torque may vary depending on the firing fraction.

There are various other possible sources of friction or pumping losses. For example, working chambers may be skipped in a variety of ways. In various approaches, a low pressure spring is formed in the working chamber i.e., after exhaust gases are released from the working chamber in a prior working cycle, neither the intake valves nor the exhaust valves are opened during a subsequent working cycle, thus forming a low pressure vacuum in the working chamber. In still other embodiments, a high pressure spring is formed in the skipped working chamber i.e., air and/or exhaust gases are prevented from escaping the working chamber. These different types of approaches may have different effects on friction or pumping losses. In various embodiments, the calculation of the reference engine brake torque and the estimation of friction/pumping losses take these effects into account.

Any suitable data structure, formula, algorithm or control system may be used to determine the reference engine brake torque. In some embodiments, a lookup table may be used. For example, the diagnostic module 165 may consult a lookup table that uses firing fraction as an index and for any given firing fraction, indicates friction and/or a reference engine brake torque. The lookup table may include indices for other operational parameters e.g., engine speed, etc.

After the diagnostic module estimates friction/pumping losses and/or the reference engine brake torque is determined, the diagnostic module 165 compares the reference engine (brake) torque to the operational engine torque determined in step 205. The diagnostic module 165 performs diagnostic routines based on the comparison. For example, if the difference between the reference engine brake torque and the operational torque exceeds a predefined threshold, the diagnostic module 165 may determine that there is a problem with the way that the operational engine torque is calculated. Various diagnostic/remedial actions may then be taken e.g., the diagnostic module 165 may transmit a signal, which causes the display of a warning message indicating that an engine problem should be diagnosed and repaired.

The operations described in method may be performed very rapidly. In some embodiments, for example, the operations illustrated in method are performed on a firing opportunity by firing opportunity basis (or a working cycle by working cycle basis.) In other embodiments, method 200 is performed less frequently (e.g., on an engine cycle by engine cycle basis or over some other time interval that is appropriate for diagnostics, as for example, every 500 msec).

The invention has been described primarily in the context of a control system for a 4-stroke piston engine suitable for use in motor vehicles. However, it should be appreciated that the described skip fire approaches are very well suited for use in a wide variety of internal combustion engines. These include engines for virtually any type of vehicle—including cars, trucks, boats, construction equipment, aircraft, motorcycles, scooters, etc.; and virtually any other application that involves the firing of working chambers and utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkinson cycle engines, Wankel engines and other types of rotary engines, mixed cycle engines (such as dual Otto and diesel engines), radial engines, etc. It is also believed that the described approaches will work well with newly developed internal combustion engines regardless of whether they operate utilizing currently known, or later developed thermodynamic cycles.

In some preferred embodiments, the firing timing determination module utilizes sigma delta conversion. Although it is believed that sigma delta converters are very well suited for use in this application, it should be appreciated that the converters may employ a wide variety of modulation schemes. For example, pulse width modulation, pulse height modulation, CDMA oriented modulation or other modulation schemes may be used to deliver the drive pulse signal. Some of the described embodiments utilize first order converters. However, in other embodiments higher order converters or a library of predetermined firing sequences may be used.

In general, skip fire engine control contemplates selectively skipping the firing of certain cylinders during selected firing opportunities. Thus, a particular cylinder may be fired during one engine cycle and then may be skipped during the next engine cycle and then selectively skipped or fired during the next. In this manner, even finer control of the effective engine displacement is possible. For example, firing every third cylinder in a 4 cylinder engine would provide an effective displacement of $1/3^{rd}$ of the full engine displacement, which is a fractional displacement that is not obtainable by simply deactivating a set of cylinders. Conceptually, virtually any effective displacement can be obtained using skip fire control, although in practice most implementations restrict operation to a set of available firing fractions, sequences or patterns.

It should be appreciated that the engine controller designs contemplated in this application are not limited to the specific arrangements shown in FIG. 1. One or more of the illustrated modules may be integrated together. Alternatively, the features of a particular module may instead be distributed among multiple modules. The controller may also include additional features, modules or operations based on other co-assigned patent applications, including U.S. Pat. Nos. 7,954,474; 7,886,715; 7,849,835; 7,577,511; 8,099,224; 8,131,445; 8,131,447; 9,200,587; 13/963,686; 13/953,615; 13/886,107; 9,239,037; 13/963,819; 13/961,701; 9,120,478; 13/843,567; 13/794,157; 13/842,234; 8,616,181, 9,086,020; 8,701,628; 14/207,109; and 8,880,258 and U.S. Provisional patent application Ser. No. 14/638,908 and U.S. Pat. No. 9,175,613, each of which is incorporated herein by reference in its entirety for all purposes. Any of the features, modules and operations described in the above patent documents may be added to the controller 100. In various alternative implementations, these functional blocks may be accomplished algorithmically using a microprocessor, ECU or other computation device, using analog or digital components, using programmable logic, using combinations of the foregoing and/or in any other suitable manner.

The engine controller and modules illustrated in FIG. 1 may be stored in the form of computer code in a non-transitory computer readable storage medium (e.g., in the electronic control unit of a vehicle.) The computer code, when executed by one or more processors, causes the controller/engine to perform any of the functions, operations and operations (e.g., the operations of method 200 of FIG. 2) described herein. The engine controller and modules may include any hardware or software suitable for performing the operations described herein.

The invention has been primarily described in the context of a skip fire control arrangement in which cylinders are deactivated during skipped working cycles by deactivating both the intake and exhaust valves in order to prevent air from being pumped through the cylinders during skipped working cycles. However, it should be appreciated that some skip fire valve actuation schemes contemplate deactivating only exhaust valves, or only the intake valves to effectively deactivate the cylinders and prevent the pumping of air through the cylinders. Several of the described approaches work equally well in such applications. Further, although it is generally preferable to deactivate cylinders, and thereby prevent the passing of air through the deactivated cylinders during skipped working cycles, there are some specific times when it may be desirable to pass air through a cylinder during a selected skipped working cycle. By way of example, this may be desirable when engine braking is desired and/or for specific emissions equipment related diagnostic or operational requirements. The described valve control approaches work equally well in such applications.

The invention is very well suited for use in conjunction with dynamic skip fire operation in which an accumulator or other mechanism tracks the portion of a firing that has been requested, but not delivered, or that has been delivered, but not requested such that firing decisions may be made on a firing opportunity by firing opportunity basis. However the described techniques are equally well suited for use in virtually any skip fire application (operational modes in which individual cylinders are sometimes fired and sometime skipped during operation in a particular operational mode) including skip fire operation using fixed firing patterns or firing sequences as may occur when using rolling cylinder deactivation and/or various other skip fire techniques. Similar techniques may also be used in variable stroke engine control in which the number of strokes in each working cycle are altered to effectively vary the displacement of an engine.

Although only a few embodiments of the invention have been described in detail, it should be appreciated that the invention may be implemented in many other forms without departing from the spirit or scope of the invention. For example, the drawings and the embodiments sometimes describe specific arrangements, operational steps and control mechanisms. It should be appreciated that these mechanisms and steps may be modified as appropriate to suit the needs of different applications. For example, some or all of the operations and features of the diagnostic module are not required and instead some or all of these operations may be transferred as appropriate to other modules, such as the firing fraction calculator and/or the firing timing determination unit. Additionally, although the method illustrated in FIG. 2 implies a particular order, it should be appreciated that this order is not required. In some embodiments, one or more of the described operations are reordered, replaced, modified or removed. Various measures of engine torque have been used, such as NMEP, IMEP, BMEP, etc. It should be appreciated that the methods described herein are equally applicable independent of the exact nomenclature used to express engine torque. Likewise Eq. 1 should be interpreted as being representative only and other types of formulas, using other variables, or look up tables may be used to determine a parameter indicative of engine torque. Therefore, the present embodiments should be considered illustrative and not restrictive and the invention is not to be limited to the details given herein.

What is claimed is:

1. A method for performing diagnostics on a skip fire engine control system, the skip fire engine control system including an engine having a plurality of working chambers, the method comprising:

calculating an operational engine torque;

operating an engine in a skip fire manner to deliver the operational engine torque;

calculating a reference engine torque using a torque model wherein the torque model involves estimating torque individually for each working chamber;

comparing the reference engine torque to the operational engine torque to assess accuracy of the operational engine torque calculation;

identifying a potential error when a discrepancy between the calculated reference engine torque and the calculated operational engine torque exceeds a threshold; and performing an action in response to the identification of the potential error.

2. A method as recited in claim 1 wherein the calculation of the reference engine torque takes into account differences in one or more operating parameters for different working chambers, which are caused by different firing histories of at least some of the working chambers.

3. A method as recited in claim 2 wherein:

at least two working chambers have different working chamber settings;

each of the working chamber settings is a setting for one of mass air charge, air fuel ratio and spark advance; and the torque model takes into account the different working chamber settings.

4. A method as recited in claim 1 wherein the reference engine torque is calculated based at least in part on a skip fire firing fraction used to operate the engine.

5. A method as recited in claim 1 wherein the torque model is based on a calculation of one of indicated mean effective pressure (IMEP) and net mean effective pressure (NMEP) of a working chamber.

6. A method as recited in claim 1 wherein the torque model is based on an estimate of friction and wherein the friction estimate varies depending on a skip fire firing fraction used to operate the engine.

7. A method as recited in claim 1, further comprising:

estimating a reference working chamber torque; and scaling the reference working chamber torque based on a firing fraction to determine the reference engine torque.

8. A method as recited in claim 7, further comprising:

scaling the reference working chamber torque based on the firing fraction to determine a reference engine net torque;

estimating friction based on the firing fraction; and determining a reference engine brake torque based on the reference engine net torque and the estimated friction.

9. A method as recited in claim 1 wherein the calculation of the reference engine torque and the comparison of the reference engine torque to the operational engine torque is performed on a firing opportunity by firing opportunity basis.

10. An engine controller comprising:

a torque estimation module that is arranged to calculate an operational engine torque;

a firing control unit that is arranged to operate an engine in a skip fire manner to deliver the operational engine torque; and a diagnostics module that is arranged to:

calculate a reference engine torque using a torque model wherein the torque model involves estimating torque individually for each working chamber;

compare the reference engine torque to the operational engine torque to assess accuracy of the operational engine torque calculation;

identify a potential error when a discrepancy between the calculated reference engine torque and the calculated operational engine torque exceeds a threshold; and cause an action to be performed in response to the identification of the potential error.

11. An engine controller as recited in claim 10 wherein the calculation of the reference engine torque takes into account differences in operating parameters for different working chambers, which are caused by different firing histories of the different working chambers.

12. An engine controller as recited in claim 10 wherein:

at least of two of the working chambers have different working chamber settings;

each of the working chamber settings is a setting for one of mass air charge, air fuel ratio and spark advance; and the torque model takes into account the different working chamber settings.

13. An engine controller as recited in claim 10 wherein the reference engine torque is calculated based at least in part on a skip fire firing fraction.

14. An engine controller as recited in claim 10 wherein the diagnostics module is further arranged to:

estimate a reference working chamber torque; and scale the reference working chamber torque based on a firing fraction to determine the reference engine torque.

15. An engine controller as recited in claim 14 wherein the diagnostics module is further arranged to:

scale the reference working chamber torque based on the firing fraction to determine a reference engine net torque;

estimate friction based on the firing fraction; and determine a reference engine brake torque based on the reference engine net torque and the estimated friction.

16. A non-transitory computer readable storage medium including executable computer code stored in a tangible form, the computer readable storage medium including:

executable computer code operable to calculate an operational engine torque;

executable computer code operable to operate an engine in a skip manner to deliver the operational engine torque;

executable computer code operable to calculate a reference engine torque using a torque model wherein the torque model involves estimating torque individually for each working chamber;

executable computer code operable to compare the reference engine torque to the operational engine torque to assess accuracy of the operational engine torque calculation;

executable computer code operable to identify a potential error when a discrepancy between the calculated reference engine torque and the calculated operational engine torque exceeds a threshold; and executable computer code operable to direct the performance of an action in response to the identification of the potential error.

17. A computer readable storage medium as recited in claim 16 wherein the calculation of the reference engine torque takes into account differences in operating parameters for different working chambers, which are caused by different firing histories of the different working chambers.

18. A computer readable storage medium as recited in claim 16 wherein:

at least of two of the working chambers have different working chamber settings;

each of the working chamber settings is a setting for one of mass air charge, air fuel ratio and spark advance; and the torque model takes into account the different working chamber settings.

19. A computer readable storage medium as recited in claim 16 wherein the reference engine torque is calculated at least in part based on a skip fire firing fraction.

20. A method as recited in claim 1 wherein the calculation of the reference engine torque takes into account the commanded firing fraction.

21. A method as recited in claim 1 wherein the torque model used in the reference engine torque calculation individually estimates the torque associated with each firing opportunity of each working chamber.

22. A method as recited in claim 1 wherein the action performed in response to the identification of the potential error includes generating an alert to a driver of a vehicle that includes the engine.

23. A method as recited in claim 1 wherein the action performed in response to the identification of the potential error includes recording an identification of the error in a diagnostics system.

24. A method as recited in claim 1 further comprising determining that there is a problem with the engine, an engine setting or an engine controller based at least in part of the identification of the potential error.

25. A method as recited in claim 1 wherein the action performed in response to the identification of the potential error is a diagnostic or remedial action.

26. An engine controller as recited in claim 10 wherein the action performed in response to the identification of the potential error is a diagnostic or remedial action.

27. An engine controller as recited in claim 10 wherein the torque model used in the reference engine torque calculation individually estimates the torque associated with each firing opportunity of each working chamber.

28. An engine controller as recited in claim 10 wherein the directed action performed in response to the identification of the potential error includes generating an alert to a driver of a vehicle that includes the engine.

29. An engine controller as recited in claim 10 wherein the action performed in response to the identification of the potential error includes recording an identification of the error in a diagnostics system.

30. A non-transitory computer readable storage medium as recited in claim 16 wherein the directed action is a diagnostic or remedial action.

31. A non-transitory computer readable storage medium as recited in claim 16 wherein the torque model used in the reference engine torque calculation individually estimates the torque associated with each firing opportunity of each working chamber.

32. A non-transitory computer readable storage medium as recited in claim 16 wherein the directed action includes generating an alert to a driver of a vehicle that includes the engine.

33. A non-transitory computer readable storage medium as recited in claim 16 wherein the directed action includes recording an identification of the error in a diagnostics system.

* * * * *